US005426935A

United States Patent [19]

Ogawa et al.

[11] Patent Number: 5,426,935

[45] Date of Patent: Jun. 27, 1995

[54] AIR-FUEL RATIO CONTROL SYSTEM FOR INTERNAL COMBUSTION ENGINES

[75] Inventors: Ken Ogawa; Yasunori Ehara, both of Wako, Japan

[73] Assignee: Honda Giken Kogyo Kabushiki Kaisha, Tokyo, Japan

[21] Appl. No.: 64,219

[22] Filed: May 19, 1993

[30] Foreign Application Priority Data

May 19, 1992 [JP] Japan ..... 4-151511
May 19, 1992 [JP] Japan ..... 4-151512

[51] Int. Cl.[6] ..... F01N 3/20

[52] U.S. Cl. ..... 60/276; 60/285; 123/691

[58] Field of Search ..... 60/285, 276, 274; 123/691

[56] References Cited

U.S. PATENT DOCUMENTS

| | | | |
|---|---|---|---|
| 3,939,654 | 2/1976 | Creps | 60/276 |
| 4,130,095 | 12/1978 | Bowler | 60/285 |
| 4,796,425 | 1/1989 | Nagai et al. | 60/274 |
| 5,103,640 | 4/1992 | Nada | 60/285 |
| 5,152,137 | 10/1992 | Nishizawa | 60/285 |

FOREIGN PATENT DOCUMENTS 267443 6/1990 Japan .

OTHER PUBLICATIONS

Patent Abstract of JP 2-67443 (in English) Communication from European Patent Office.
Patent Abstract of JP 61232350.
Patent Abstract of JP 4031644.

*Primary Examiner*—Douglas Hart
*Attorney, Agent, or Firm*—Lyon & Lyon

[57] ABSTRACT

An air-fuel ratio control system for an internal combustion engine includes a LAF sensor and an O2 sensor arranged in an exhaust pipe at respective locations upstream and downstream of a catalytic converter. A desired air-fuel ratio coefficient used in calculating an amount of fuel supplied to the engine is calculated based on operating conditions of the engine, and corrected based on output from the O2 sensor. The air-fuel ratio of a mixture supplied to the engine is feedback-controlled to a stoichiometric air-fuel ratio based on the corrected desired air-fuel ratio coefficient. When the output from the O2 sensor falls within a predetermined range, the desired air-fuel ratio coefficient is not corrected, but held at an immediately preceding value thereof.

5 Claims, 12 Drawing Sheets

O2 F/B PROCESSING
S101
RETRIEVE STUR MAP
S102
STUR(n)= STUR(n−1) ?
YES
NO
S61
NIVR=0 ?
YES
NO
S62
VO2<VL ?
YES
NO
S64
VO2>VH ?
YES
NO
S63
NIVR=NIVR−1
S103
ΔKCMD= ΔKCMDREF
A
B
C

AIR-FUEL RATIO CONTROL SYSTEM FOR INTERNAL COMBUSTION ENGINES

BACKGROUND 0F THE INVENTION

1. Field of the Invention

This invention relates to an air-fuel ratio control system for internal combustion engines, and more particularly to an air-fuel ratio control system which is adapted to control the air-fuel ratio of a mixture supplied to the engine to a desired air-fuel ratio, based on outputs from exhaust gas ingredient concentration sensors arranged in an exhaust passage of the engine.

2. Prior Art

It is conventionally known to arrange an exhaust gas ingredient concentration sensor (hereinafter referred to as "the LAF sensor") having an output characteristic which is substantially proportional to the concentration of an exhaust gas ingredient, in an exhaust passage of an engine, and to feedback-control the output from the LAF sensor to a value corresponding to a desired air-fuel ratio of an air-fuel mixture supplied to the engine.

However, according to this technique of the air-fuel ratio feedback control, when the desired air-fuel ratio is set to a stoichiometric air-fuel ratio (A/F=14.7), it is often actually difficult to converge the air-fuel ratio of a mixture to the stoichiometric air-fuel ratio due to an error or tolerance in the output from the sensor caused by an amplifier circuit connected to the LAF sensor, which results in degraded emission characteristics. Therefore, it is required to set a desired air-fuel ratio coefficient corresponding to the stoichiometric air-fuel ratio to a value slightly deviated from 1.0, engine by engine, on shipment thereof.

To eliminate such an inconvenience, an air-fuel ratio control system has been proposed e.g. by Japanese Provisional Patent Publication (Kokai) No. 2-67443, which comprises a LAF sensor arranged in an exhaust passage of an engine at a location upstream of a catalytic converter, and an O2 sensor arranged in same at a location downstream of the catalytic converter, an output from which drastically changes when the air-fuel ratio of a mixture supplied to the engine changes across the stoichiometric air-fuel ratio, wherein the desired output voltage of the LAF sensor or desired air-fuel ratio coefficient is corrected based on an output from the O2 sensor in controlling the air-fuel ratio to the stoichiometric air-fuel ratio, whereby the output from the LAF sensor is feedback-controlled to the corrected desired output voltage or an equivalent ratio of the output from the LAF sensor is feedback-controlled to the corrected desired air-fuel ratio coefficient.

According to the proposed air-fuel ratio control system, it is possible to perform an accurate air-fuel ratio control to the stoichiometric air-fuel ratio based on the output from the O2 sensor by always causing the desired output voltage from the LAF sensor or the desired air-fuel ratio coefficient to assume a value actually corresponding to the stoichiometric air-fuel ratio.

However, in this conventional air-fuel ratio control system, if the output from the O2 sensor falls within a predetermined particular range during the air-fuel ratio feedback control to the stoichiometric air-fuel ratio, it means that the air-fuel ratio of a mixture supplied to the engine has been controlled to the stoichiometric air-fuel ratio and hence that the desired output voltage from the LAF sensor and the desired air-fuel ratio coefficient assume respective values substantially accurately corresponding to the stoichiometric air-fuel ratio by this conventional system. Nevertheless, during the air-fuel ratio control to the stoichiometric air-fuel ratio, the air-fuel ratio of the mixture is always feedback-controlled based on the output from the O2 sensor (this specific air-fuel ratio feedback control to the stoichiometric air-fuel ratio based on the output from the O2 sensor will be hereinafter referred to as "the O2 feedback control"). In other words, although the air-fuel ratio of the mixture can be controlled to the desired air-fuel ratio, i.e. to the stoichiometric air-fuel ratio without the O2 feedback control, the O2 feedback control is unnecessarily carried out, which can result in all the more degraded air-fuel ratio controllability in the aforementioned predetermined range, e.g. due to fluctuation in the desired output voltage from the LAF sensor or the desired air-fuel ratio coefficient, preventing the air-fuel ratio feedback control from being executed in a desired manner.

Further, even if the O2 feedback control is carried out when there is a large difference between an actual value of the output from the O2 sensor and a value of same corresponding to the stoichiometric air-fuel ratio, e.g. when the output from the O2 sensor is lower than a predetermined lower limit value, or higher than a predetermined higher limit value, it is difficult to quickly converge the air-fuel ratio of the mixture to the stoichiometric air-fuel ratio, and in the worst case, there is a possibility of diverging the air-fuel ratio of the mixture. In other words, even if the feedback control is carried out when the output from the O2 sensor is lower than the predetermined lower limit value, the control system can only exhibit a poor air-fuel ratio converging characteristic, causing an undesired emission of NOx, while even if the feedback control is carried out when the output from the O2 sensor is higher than the predetermined higher limit value, this gives rise to an undesired emission of CO and HC for the same reason, in both cases, resulting in degraded exhaust emission characteristics of the engine.

SUMMARY OF THE INVENTION

It is a first object of the invention to provide an air-fuel ratio control system for an internal combustion engine which is capable of achieving improved exhaust emission characteristics of the engine.

It is a second object of the invention to provide an air-fuel ratio control system for an internal combustion engine which is capable of preventing degradation of the air-fuel ratio controllability due to aging of an O2 sensor, and resulting degradation of the exhaust emission characteristics; of the engine.

To attain the objects, the present invention provides an air-fuel ratio control system for an internal combustion engine having an exhaust passage and a catalytic converter arranged in the exhaust passage for purifying noxious components contained in exhaust gases, the air-fuel ratio control system including a first exhaust gas ingredient concentration sensor arranged in the exhaust passage at a location upstream of the catalytic converter and having an output characteristic which is substantially proportional to the concentration of an ingredient in the exhaust gases, engine operating condition-detecting means for detecting operating conditions of the engine, desired air-fuel ratio coefficient-calculating means for calculating a desired air-fuel ratio coefficient used in calculating an amount of fuel supplied to the engine, based on results of detection by the engine operating condition-determining means, a second exhaust gas ingredient concentration sensor arranged in the exhaust passage at a location downstream of the catalytic converter and having an output characteristic that an output therefrom drastically changes in the vicinity of a stoichiometric air-fuel ratio of a mixture supplied to the engine, and correcting means for correcting the desired air-fuel ratio coefficient based on the output from the second exhaust gas ingredient concentration sensor, wherein the air-fuel ratio of the mixture detected by the first exhaust gas ingredient concentration sensor is feedback-controlled to the stoichiometric air-fuel ratio based on the desired air-fuel ratio coefficient corrected by the correcting means.

The air-fuel ratio control system according to the invention is characterized by comprising inhibiting means for inhibiting the correcting means from making a correction to the desired air-fuel ratio coefficient when the output from the second exhaust gas ingredient concentration sensor falls within a predetermined range, and means for holding the desired air-fuel ratio coefficient to a value assumed immediately before the correcting means has been inhibited from making the correction, when the inhibiting means has inhibited the correcting means from making the correction.

Preferably, the predetermined range of the output from the second exhaust gas ingredient concentration sensor is a range within which the air-fuel ratio of the mixture is substantially equal to the stoichiometric value.

More preferably, the correcting means comprises an atmospheric pressure sensor for detecting atmospheric pressure, an initial value-determining means for determining an initial value of a desired value of the output from the second exhaust gas ingredient concentration sensor based on results of detection by the atmospheric pressure sensor, desired value-calculating means for calculating the desired value of the output from the second exhaust gas ingredient concentration sensor based on a difference between the initial value of the desired value and the output from the second exhaust gas ingredient concentration sensor, and desired value-setting means for setting the desired value of the output from the second exhaust gas ingredient concentration sensor to a predetermined upper or lower limit value when the desired value calculated by the desired value-calculating means falls outside a range defined by the predetermined upper and lower limit values.

Further preferably, the correcting means corrects the desired air-fuel ratio coefficient based on the desired value of the output from the second exhaust gas ingredient concentration sensor.

Particularly to attain the second object of the invention, it is preferred that the correcting means comprises an average value-calculating means for calculating an average value of the desired value calculated by the desired value-calculating means, operating region-determining means for determining, based on results of detection by the engine operating condition-detecting means, in which operating region of a plurality of operating regions the engine is operating, and memory means for storing a value of the average value calculated by the average value-calculating means in each of the operating regions, and that if an operating region determined by the operating region-determining means in the present loop is equal to that determined in the immediately preceding loop, the average value of the desired value is updated, and the desired air-fuel ratio coefficient is corrected based on the updated average value, whereas if an operating region determined by the operating region-determining means in the present loop is different from that determined in the immediately preceding loop, the desired air-fuel ratio coefficient is corrected based on the average value of the desired value stored in the memory means.

The above and other objects, features, and advantages of the invention will become more apparent from the ensuing detailed description taken in conjunction with the accompanying drawings.

DETAILED DESCRIPTION

The invention will now be described in detail with reference to the drawings showing embodiments thereof.

Figure 1:
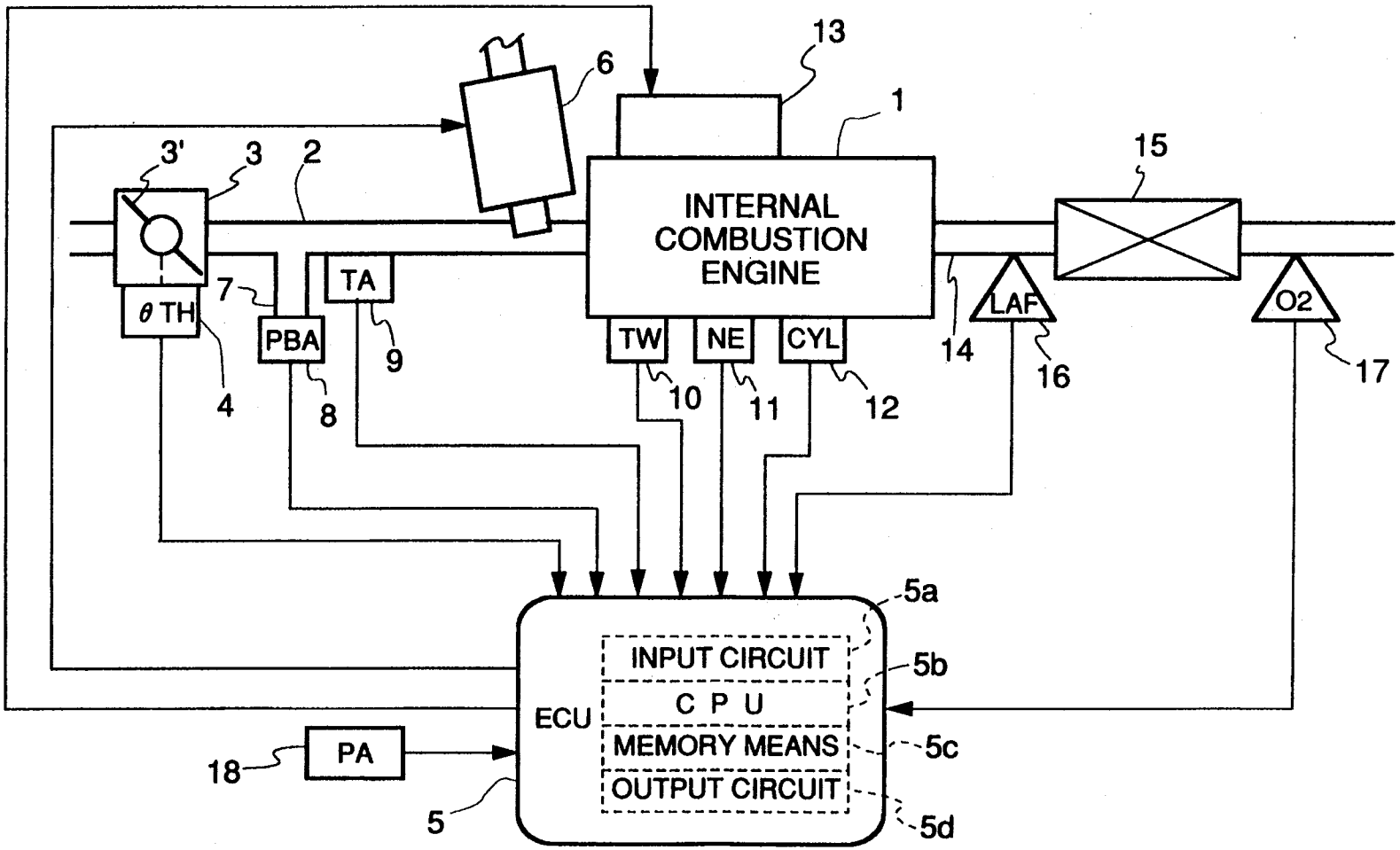
FIG. 1 is a block diagram showing the whole arrangement for an air-fuel ratio control system for an internal combustion engine according to embodiments of the invention.

Referring first to FIG. 1, there is illustrated the whole arrangement of an air-fuel ratio control system for an internal combustion engine according to the invention.

In the figure, reference numeral 1 designates an internal combustion engine (hereinafter simply referred to as "the engine") having four cylinders, not shown, for instance. Connected to the cylinder block of the engine 1 is an intake pipe 2 across which is arranged a throttle body 3 accommodating a throttle valve 3' therein. A throttle valve opening (θTH) sensor 4 is connected to the throttle valve 3' for generating an electric signal indicative of the sensed throttle valve opening and supplying same to an electronic control unit (hereinafter referred to as "the ECU") 5.

Fuel injection valves 6, only one of which is shown, are inserted into the interior of the intake pipe 2 at locations intermediate between the cylinder block of the engine 1 and the throttle valve 3'and slightly upstream of respective intake valves, not shown. The fuel injection valves 6 are connected to a fuel pump, not shown, and electrically connected to the ECU 5 to have their valve opening periods controlled by signals therefrom.

Further, an intake pipe absolute pressure (PBA) sensor 8 is provided in communication with the interior of the intake pipe 2 via a conduit 7 opening into the intake pipe 2 at a location downstream of the throttle valve 3' for supplying an electric signal indicative of the sensed absolute pressure within the intake pipe 2 to the ECU 5.

An intake air temperature (TA) sensor 9 is inserted into the intake pipe 2 at a location downstream of the conduit 7 for supplying an electric signal indicative of the sensed intake air temperature TA to the ECU 5.

An engine coolant temperature (TW) sensor 10 formed of a thermistor or the like is inserted into a coolant passage filled with a coolant and formed in the cylinder block, for supplying an electric signal indicative of the sensed engine coolant temperature TW to the ECU 5.

An engine rotational speed (NE) sensor 11 and a cylinder-discriminating (CYL) sensor 12 are arranged in facing relation to a camshaft or a crankshaft of the engine 1, neither of which is shown.

The NE sensor 11 generates a pulse as a TDC signal pulse at each of predetermined crank angles whenever the crankshaft rotates through 180 degrees, while the CYL sensor 12 generates a pulse at a predetermined crank angle of a particular cylinder of the engine, both of the pulses being supplied to the ECU 5.

Each cylinder of the engine has a spark plug 13 electrically connected to the ECU 5 to have its ignition timing controlled by a signal therefrom.

A catalytic converter (three-way catalyst) 15 is arranged in an exhaust pipe 14 connected to the cylinder block of the engine 1, for purifying noxious components in the exhaust gases, such as HC, CO, and NOx.

A linear oxygen concentration sensor (hereinafter referred to as "the LAF sensor") 16 and an oxygen concentration sensor (hereinafter referred to as "the O2 sensor") 17 are arranged in the exhaust pipe 14 at locations upstream and downstream of the three-way catalyst 15, respectively.

The LAF sensor 16 comprises a sensor element formed of a solid electrolytic material of zirconia ($ZrO_2$) and having two pairs of cell elements and oxygen pumping elements mounted at respective upper and lower locations thereof, and an amplifier circuit electrically connected thereto. The LAF sensor 16 generates and supplies an electric signal, an output level from which is substantially proportional to the oxygen concentration in exhaust gases flowing through the sensor element, to the ECU 5.

The O2 sensor 17 is also formed of a solid electrolytic material of zirconia (ZrO2) like the LAF sensor 16 and having a characteristic that an electromotive force thereof drastically changes when the air-fuel ratio of the mixture changes across the stoichiometric value, so that an output therefrom is inverted from a lean value-indicating signal to a rich value-indicating signal, or vice versa, when the air-fuel ratio of the mixture changes across the stoichiometric value. More specifically, the O2 sensor 17 generates and supplies a high level signal when the air-fuel ratio of the mixture is rich, and a low level signal when it is lean, to the ECU 5.

An atmospheric pressure (PA) sensor 18 is arranged in the engine at a proper location thereof for supplying the ECU 5 with an electric signal indicative of the atmospheric pressure PA sensed thereby.

The ECU 5 comprises an input circuit **5*a* having the functions of shaping the waveforms of input signals from various sensors as mentioned above, shifting the voltage levels of sensor output signals to a predetermined level, converting analog signals from analog-output sensors to digital signals, and so forth, a central processing unit (hereinafter referred to as the "the CPU") 5*b*, memory means 5*c* formed of a ROM storing various operational programs which are executed by the CPU 5*b*, and various maps and tables, referred to hereinafter, and a RAM for storing results of calculations therefrom, etc., an output circuit 5*d* which outputs driving signals to the fuel injection valves 6 and the spark plugs 13**, respectively.

The CPU **5*b* operates in response to the above-mentioned signals from the sensors to determine operating conditions in which the engine 1 is operating, such as an air-fuel ratio feedback control region and open-loop control regions, and calculates, based upon the determined engine operating conditions, the valve opening period or fuel injection period TOUT over which the fuel injection valves 6 are to be opened by the use of the following equation (1) when the engine is in a basic operating mode, and by the use of the following equation (2) when the engine is in a starting mode, in synchronism with generation of TDC signal pulses, and stores the results of calculation into the memory means 5*c*** (RAM):

$$TOUT = TiM \times KCMDM \times KLAF \times K1 + K2 \quad (1)$$

$$TOUT = TiCR \times K3 + K4 \quad (2)$$

where TiM represents a basic fuel injection period used when the engine is in the basic operating mode, which, specifically, is determined according to the engine rotational speed NE and the intake pipe absolute pressure PBA. A TiM map used in determining a value of TiM is stored in the memory means **5*c*** (ROM).

TiCR represents a basic fuel injection period used when the engine is in the starting mode, which is determined according to the engine rotational speed NE and the intake pipe absolute pressure PBA, similarly to TiM. A TiCR map used in determining a value of TiCR is stored in the memory means **5*c*** (ROM), as well.

KCMDM represents a modified desired air-fuel ratio coefficient, which is set based on a desired air-fuel ratio coefficient KCMD determined based on operating conditions of the engine, and an air-fuel ratio correction value ΔKCMD determined based on an output from the O2 sensor 17, as will be described later.

KLAF represents an air-fuel ratio correction coefficient, which is set during the air-fuel ratio feedback control such that the air-fuel ratio detected by the LAF sensor 16 becomes equal to a desired air-fuel ratio set by the KCMDM value, and set during the open-loop control to predetermined values depending on operating conditions of the engine.

K1 and K3 represent correction coefficients and K2 and K4 represent correction variables. The correction coefficients and variables are set depending on operating conditions of the engine to such values as will optimize operating characteristics of the engine, such as fuel consumption and accelerability.

Next, there will be described how the air-fuel ratio control system according to the invention carries out the air-fuel ratio feedback control by the CPU 5*b* thereof.

Figure 2:
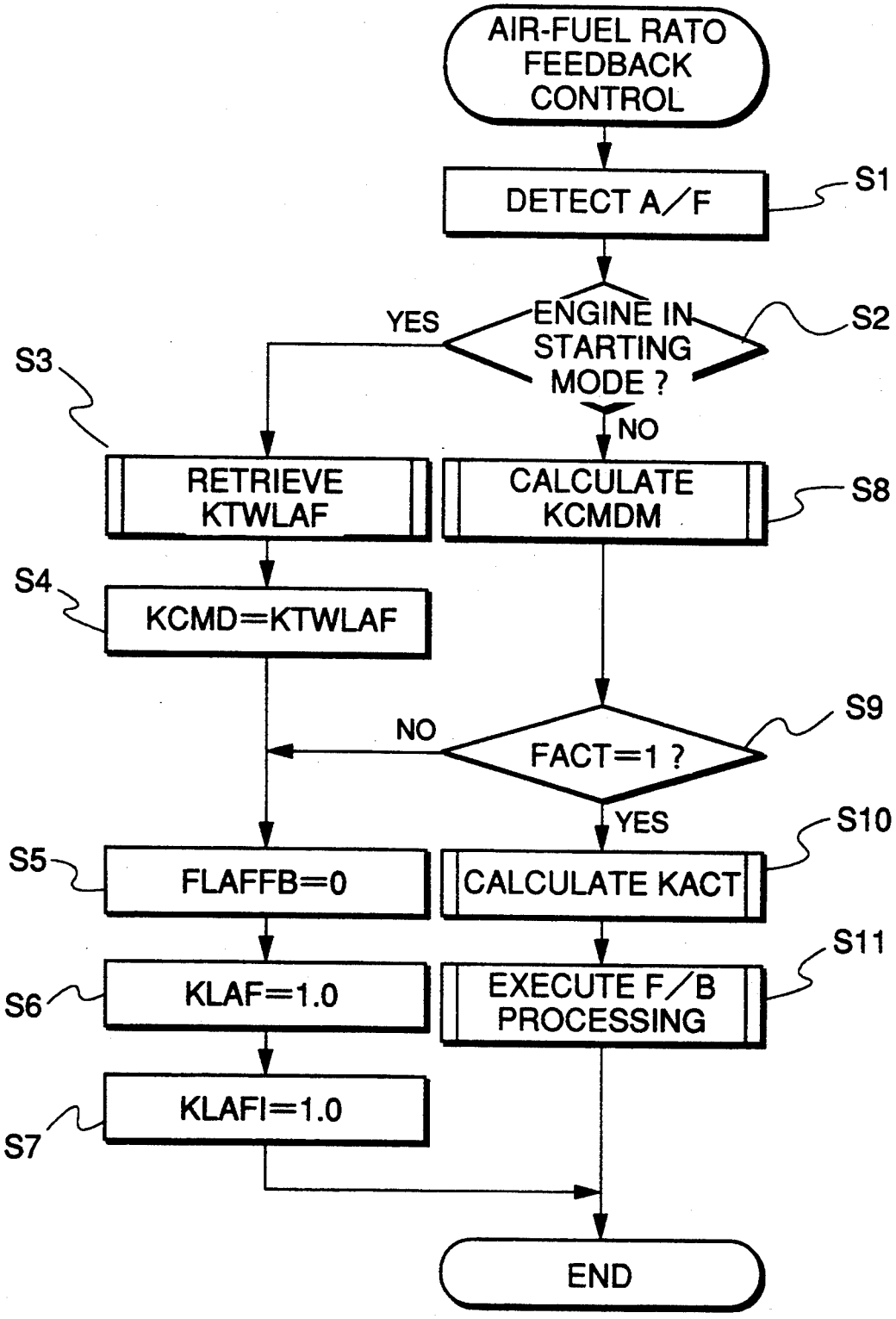
FIG. 2 is a flowchart of a main routine for the air-fuel ratio feedback control of the internal combustion engine according to the embodiments of the invention.

FIG. 2 shows a main routine for the air-fuel ratio feedback control.

First, at a step S1, an output value from the LAF sensor 16 is read. Then at a step S2, it is determined whether or not the engine is in the starting mode. The determination of the starting mode is carried out by determining whether or not a starter switch, not shown, of the engine has been turned on, and at the same time the engine rotational speed NE is below a predetermined value (cranking rotational speed).

If the answer to the question of the step S2 is affirmative (YES), i.e. if the engine is in the starting mode, which implies that the engine temperatures is low, and hence a value of a desired air-fuel ratio coefficient KTWLAF suitable for low engine temperature is determined at a step S3 by retrieving a KTWLAF map according to the engine coolant temperature TW and the intake pipe absolute pressure PBA, and the determined KTWLAF value is set to the desired air-fuel ratio coefficient KCMD at a step S4. Then, a flag FLAFFB is set to "0" at a step S5 to inhibit the air-fuel ratio feedback control, and the air-fuel ratio correction coefficient KLAF and an integral term (I term) thereof KLAFI are both set to 1.0 at respective steps S6 and S7, followed by terminating the program.

On the other hand, if the answer to the question of the step S2 is negative (NO), i.e. if the engine is in the basic mode, the modified desired air-fuel ratio coefficient KCMDM is determined at a step S8 according to a KCMDM-determining routine described hereinafter with reference to FIG. 3, and then it is determined at a step S9 whether or not a flag FACT is equal to "1" in order to judge whether the LAF sensor 16 has been activated. The determination of whether the LAF sensor 16 has been activated is carried out according to another routine, not shown, which is executed by background processing, in which when the difference between an actual value VOUT of the output voltage from the LAF sensor 16 and a predetermined central voltage value VCENT of same is smaller than a predetermine value (e.g. 0.4 V), for instance, it is determined that the LAF sensor 16 has been activated.

Then, if the answer to the question of the step S9 is negative (NO), the program proceeds to the step S5, whereas if the answer to the question of the step S9 is affirmative (YES), i.e. if the LAF sensor 16 has been activated, the program proceeds to a step S10, where an equivalent ratio KACT (14.7/(A/F)) of the air-fuel ratio detected by the LAF sensor 16 (hereinafter referred to as "the detected air-fuel ratio coefficient") is calculated. The detected air-fuel ratio coefficient KACT is corrected, in calculation thereof, based on the intake pipe absolute pressure PBA, the engine rotational speed NE, and the atmospheric pressure PA, by taking into account the fact that the pressure of exhaust gases vary with these operating parameters of the engine. Specifically, the detected air-fuel ratio coefficient KACT is determined by executing a KACT-calculating routine, not shown.

Then, at a step S11, a feedback processing routine is executed, followed by terminating the program. More specifically, if predetermined feedback control conditions are not satisfied, the flag FLAFFB is set to "0" to inhibit the air-fuel ratio feedback control, whereas if the predetermined feedback control conditions are satisfied, the flag FLAFFB is set to "1", and the air-fuel ratio correction coefficient KLAF is calculated, while outputting instructions for execution of the air-fuel ratio feedback control, followed by terminating the program.

Figure 3:
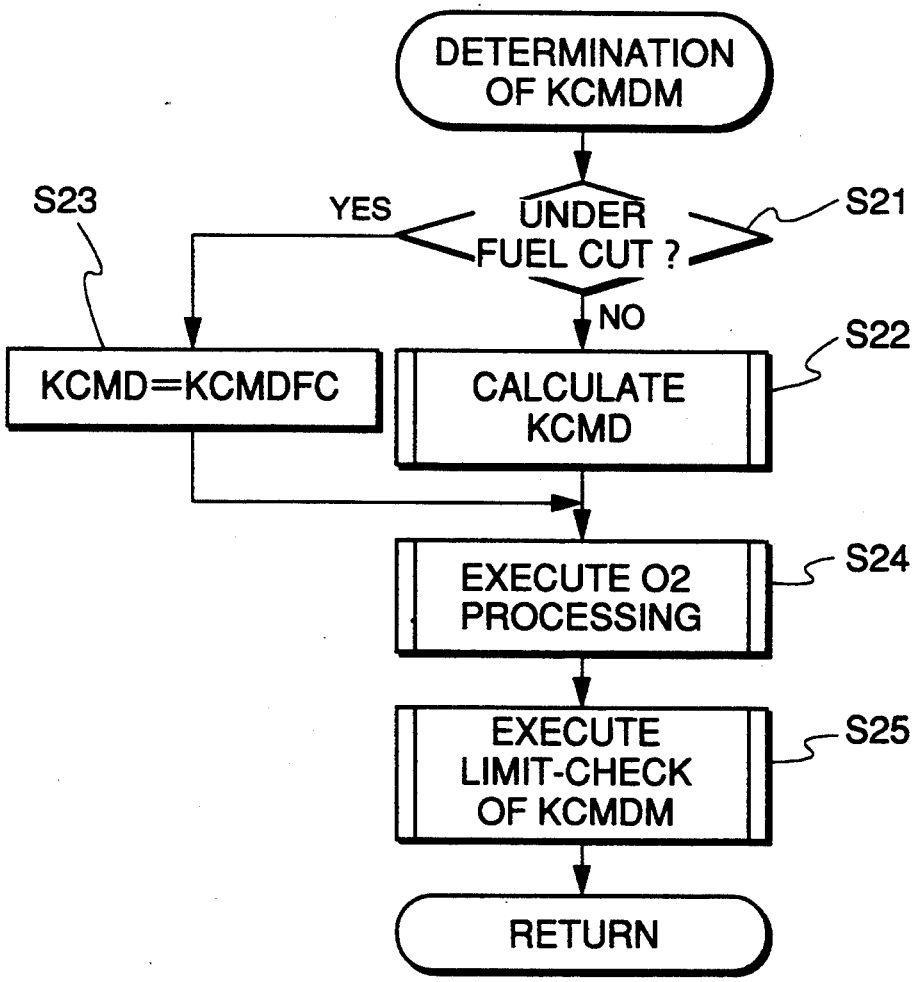
FIG. 3 is a flowchart of a KCMDM-determining routine.

FIG. 3 shows the aforementioned KCMDM-determining routine executed at the step S8 in FIG. 2, which is executed in synchronism with generation of TDC signal pulses.

First, at a step S21, it is determined whether or not the engine is under fuel cut. The determination of fuel cut is carried out based on the engine rotational speed NE and the valve opening $\theta$TH of the throttle valve 3', and more specifically determined by a fuel cut-determining routine, not shown.

If the answer to the question of the step S21 is negative (NO), i.e. if the engine is not under fuel cut, the program proceeds to a step S22, where the desired air-fuel ratio coefficient KCMD is determined. The desired air-fuel ratio coefficient KCMD is normally read from a KCMD map according to the engine rotational speed NE and the intake pipe absolute pressure PBA, which map is set such that predetermined KCMD map values are provided correspondingly to predetermined values of the engine rotational speed NE and those of the intake pipe absolute pressure PBA. When a vehicle on which the engine is installed is performing standing start, or the engine is in a low temperature condition, or in a predetermined high load condition, a map value read is corrected to a suitable value, specifically by executing a KCMD-determining routine, not shown. The program then proceeds to a step S24.

On the other hand, if the answer to the question of the step S21 is affirmative (YES), the desired air-fuel ratio coefficient KCMD is set to a predetermined value KCMDFC (e.g. 1.0) at a step S23, and then the program proceeds to the step S24.

At the step S24, O2 processing is executed. More specifically, the desired air-fuel ratio coefficient KCMD is corrected based on the output from the O2 sensor 17 to obtain the modified desired air-fuel ratio coefficient KCMDM, under predetermined conditions, as will be described hereinafter.

Then, at the following step S25, a limit-check of the modified desired air-fuel ratio coefficient KCMDM is carried out, followed by terminating the present subroutine to return to the main routine in FIG. 2. More specifically, the KCMDM value calculated at the step S24 is compared with predetermined upper and lower limit values KCMDMH and KCMDML, and if the KCMDM value is larger than the predetermined upper limit value KCMDMH, the former is corrected to the latter, whereas if the KCMDM value is smaller than the predetermined lower limit value KCMDML, the former is corrected to the latter.

Figure 4:
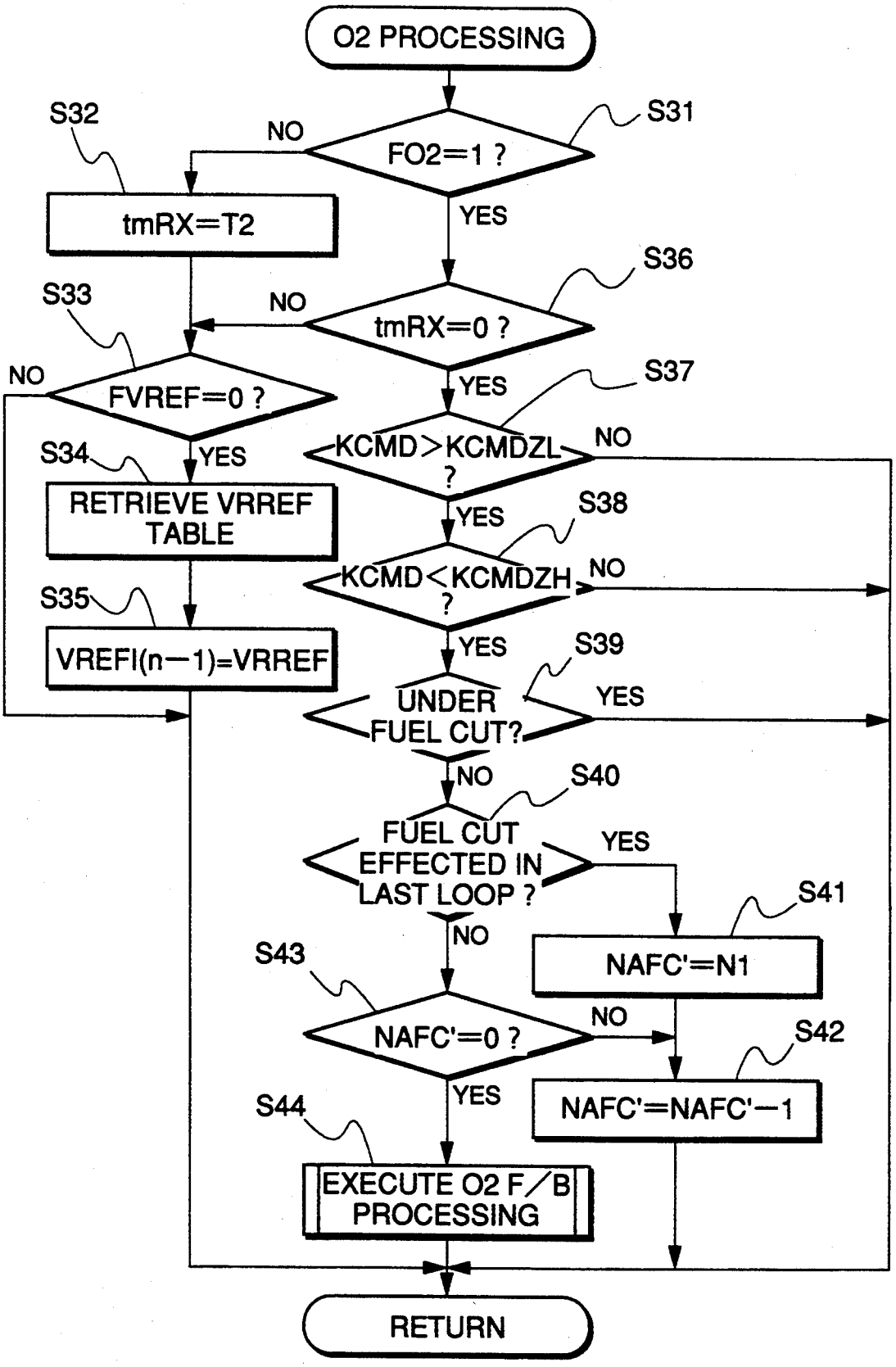
FIG. 4 is a flowchart of an O2 processing routine.

FIG. 4 shows an O2 processing routine executed at the step S24 in FIG. 3, which is executed in synchronism with generation of TDC signal pulses.

First, at a step S31, it is determined whether or not a flag FO2 is equal to "1" to determine whether the O2 sensor 17 has been activated. The determination of activation of the O2 sensor 17 is carried out, specifically by executing an O2 sensor activation-determining routine shown in FIG. 5, by background processing.

Figure 5:
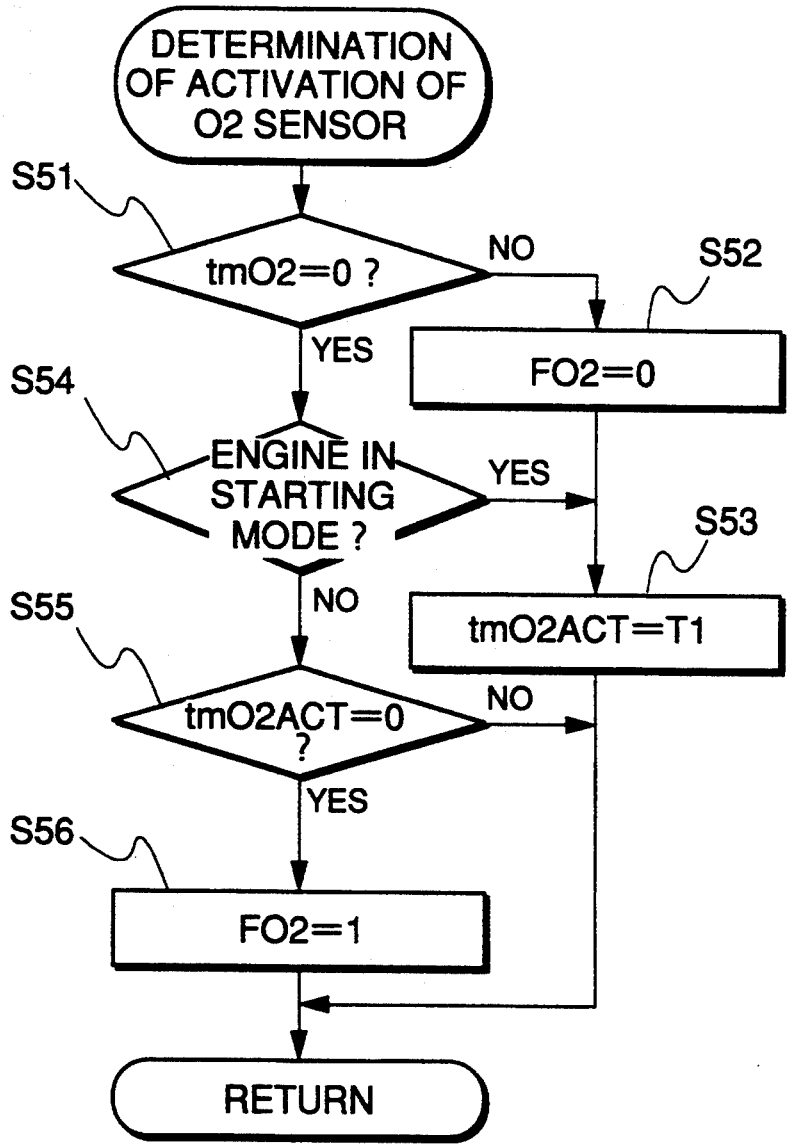
FIG. 5 is a flowchart of an O2 sensor activation-determining routine for determining whether an O2 sensor has been activated.

Referring to FIG. 5, first at a step S51, it is determined whether or not the count value of an activation-determining timer tmO2, which is set to a predetermined value (e.g. 2.56 sec.) when an ignition switch, not shown, is turned on, is equal to "0". If the answer to this question is negative (NO), it is judged that the; O2 sensor 17 has not been activated, so that the flag F02 is set to "0" at a step S52, and then an O2 sensor forcible activation timer tmO2ACT is set to a predetermined value T1 (e.g. 2.56 sec.) and started, at a step S53, followed by terminating the program.

On the other hand, if the answer to the question of the step S51 is affirmative (YES), it is determined at a step S54 whether or not the engine is in the starting mode. If the answer to this question is affirmative (YES), the program proceeds to the step S53.

If the answer to the question of the step S54 is negative (NO), the program proceeds to a step S55, where it is determined whether or not the count value of the forcible activation timer tmO2ACT is equal to "0". If the answer to this question is negative (NO), the present program is immediately terminated, whereas if the answer is affirmative (YES), it is judged that the O2 sensor 17 has been activated, so that the flag FO2 is set to "1" at a step S56, followed by terminating the program.

Thus, as a result of execution of the O2 sensor activation-determining routine shown in FIG. 5, if the answer to the question of the step S31 in FIG. 4 is negative (NO), i.e. if it is determined that the O2 sensor 17 has not been activated, the program proceeds to a step S32, where a timer tmRX is set to a predetermined value T2 (e.g. 0.25 sec.), and then it is determined at a step S33 whether or not a flag FVREF is equal to "0" to thereby determine whether or not a desired value VREF of output voltage VO2 from the O2 sensor 17 has not been set to an initial value thereof (hereinafter referred to as "the initial desired value") VRREF, yet.

In the first loop, the answer to the question of the step S33 is affirmative (YES), the program proceeds to a step S34, where a VRREF table stored in the memory means 5c (ROM) is retrieved to determined the initial desired value VRREF.

Figure 6:
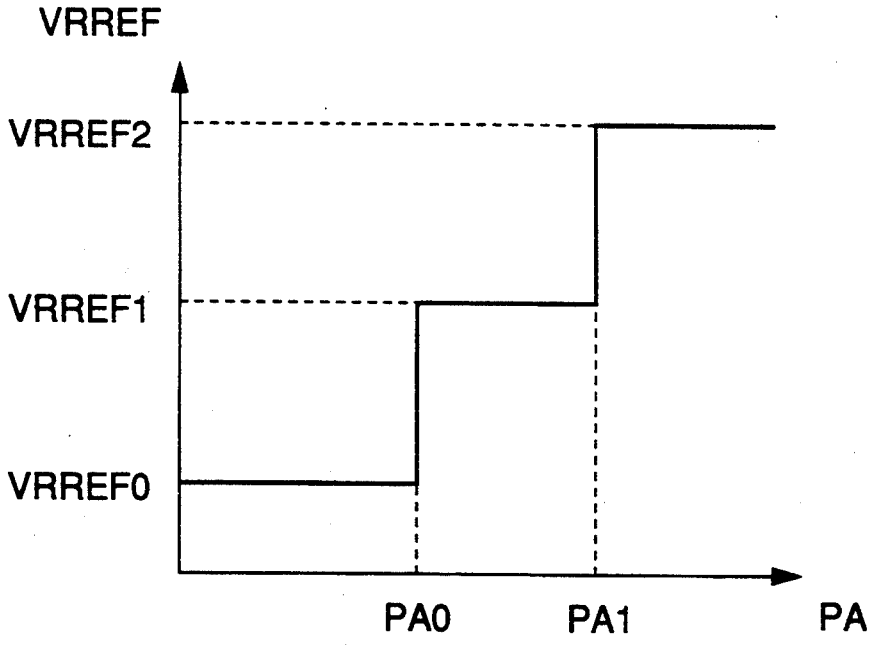
FIG. 6 shows a VRREF table.

The VRREF table is set, e.g. as shown in FIG. 6, such that table values VRREF0 to VRREF2 are provided in a manner stepwise corresponding to predetermined values PA0 to PA1 of the atmospheric pressure PA detected by the PA sensor 18. The initial desired value VRREF is determined by retrieving this table or additionally by interpolation, if required. In this connection, the initial desired value VRREF is set to a larger value as the atmospheric pressure PA assumes a higher value.

Then, at a step S35, the integral term (I term) VREFI(n−1) of the desired value VREF in the immediately preceding loop is set to the initial desired value VRREF, and this subroutine is terminated, followed by the program returning to the main routine shown in FIG. 2. In the following loops, the answer to the question of the step S33 is negative (NO), since the desired value VREF has already been set to the initial desired value VRREF as described above, so that the present routine is terminated without executing the steps S34 and S35.

Further, if the answer to the question of the step S31 is affirmative (YES), it is judged that the O2 sensor 17 has been activated, and the program proceeds to a step S36, where it is determined whether or not the count value of the timer tmRX is equal to "0". If the answer to this question is negative (NO), the program proceeds to the step S33, whereas if the answer is affirmative (YES), it is judged that the activation of the O2 sensor 17 is complete, and the program proceeds to a step S37, where it is determined whether or not the desired air-fuel ratio coefficient KCMD set at the step S22 or S23 in the FIG. 3 routine is larger than a predetermined lower limit value KCMDZL (e.g. 0.98). If the answer to this question is negative (NO), it means that the air-fuel ratio of the mixture is controlled to a value suitable for so-called lean burn, so that the present routine is immediately terminated, whereas if the answer is affirmative (YES), the program proceeds to a step S38, where it is determined whether or not the desired air-fuel ratio coefficient KCMD is smaller than a predetermined upper limit value KCMDZH (e.g. 1.13). If the answer to this question is negative (NO), it means that the air-fuel ratio of the mixture is controlled to a rich value, so that the present routine is immediately terminated, whereas if the answer is affirmative (YES), it means that the air-fuel ratio of the mixture is to be controlled to the stoichiometric value (A/F=14.7), so that the program proceeds to a step S39, where it is determined whether or not the engine is under fuel cut. If the answer to this question is affirmative (YES), the present routine is immediately terminated to return to the FIG. 3 routine, whereas if the answer is negative (NO), it is determined at a step S40 whether or not the engine was under fuel cut in the immediately preceding loop. If the answer to this question is affirmative (YES), the count value NAFC' of a counter NAFC is set to a predetermined value N1 (e.g. 4) at a step S41, and the count value NAFC' is decreased by a decremental value of "1" at a step S42, followed by terminating the present routine.

On the other hand, if the answer to the question of the step S40 is negative (NO), the program proceeds to a step S43, where is determined whether or not the count value NAFC' of the counter NAFC is equal to "0". If the answer to this question is negative (NO), the program proceeds to the step S42, whereas if the answer is affirmative (YES), it is judged that the fuel supply has been stabilized after termination of fuel cut, and the program proceeds to a step S44, where the O2 feedback processing is executed, followed by terminating the present routine to return to the FIG. 3 routine.

Figure 7:
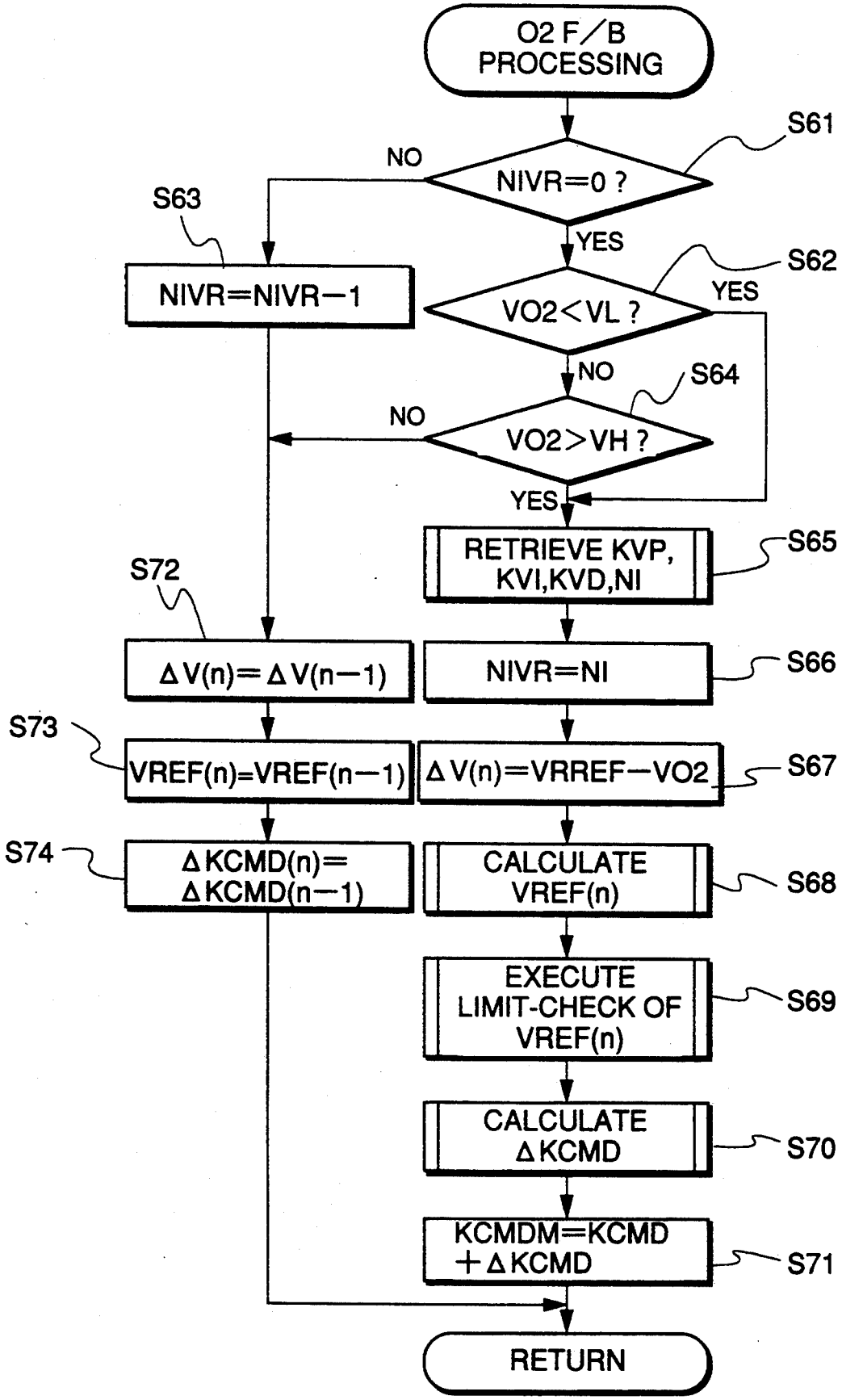
FIG. 7 is a flowchart of an O2 feedback control routine according to a first embodiment of the invention.

FIG. 7 shows an O2 feedback processing routine carried out at the step S44 of the FIG. 4 routine, which is executed in synchronism with generation of TDC signal pulses.

First, at a step S61, it is determined whether or not a thinning-out variable NIVR is equal to "0". The thinning-out variable NIVR is a variable which is reduced to 0 whenever a thinning-out number NI, which is set depending on operating conditions of the engine as will be described later, of TDC signal pulses are generated. The answer to the question of the step S61 in the first loop is affirmative (YES), since the variable NIVR has not been set to the number NI, so that the program proceeds to a step S62.

Further, if the answer to the question of the step S61 becomes negative in the following loops, the program proceeds to a step S63, where a decremental value of 1 is subtracted from the thinning-out variable NIVR, followed by the program proceeding to a step S72, referred to hereinafter.

At the step S62, it is determined whether or not output voltage VO2 from the O2 sensor 17 is lower than a predetermined lower limit value VL (e.g. 0.3 V). If the answer to this question is affirmative (YES), it is judged that the air-fuel ratio of the mixture is biased from the stoichiometric value to a leaner value, so that the program proceeds to a step S65, whereas if the answer is negative (NO), the program proceeds to a step S64, where it is determined whether or not the output voltage VO2 from the O2 sensor 17 is higher than a predetermined upper limit value (e.g. 0.8). If the answer to this question is affirmative (YES), it is judged that the; air-fuel ratio of the mixture is biased from the stoichiometric value to a richer value, so that the program proceeds to the step S65.

Figure 8:
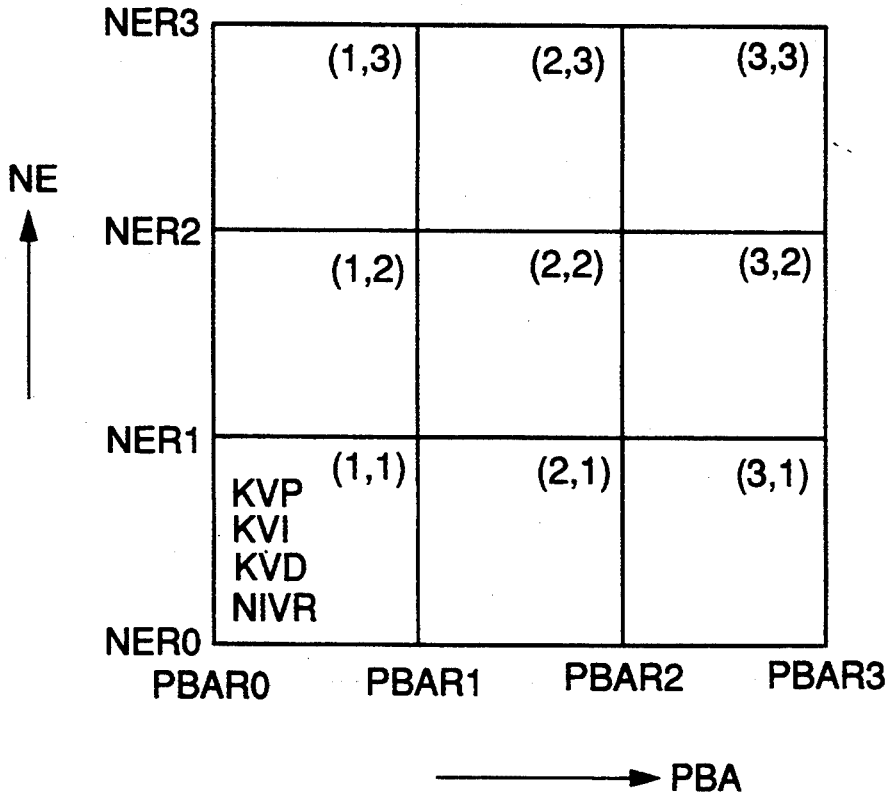
FIG. 8 shows a NE-PBA map collectively showing KVP, KVI, KVD and NI maps.

At the step S65, a KVP map, a KVI map, a KVD map, and an NI map are retrieved to determine control parameters indicative of rate of change in the O2 feedback control, i.e. a proportional term (P term) coefficient KVP, an integral term (I term) coefficient KVI, and a differential term (D term) coefficient KVD, and the aforementioned thinning-out number NI. The KVP map, the KVI map, the KVD map, and the NI map are set, e.g. as shown in FIG. 8, such that predetermined map values for the respective coefficients KVP, KVI KVD and number NI are provided in a manner corresponding to regions (1,1) to (3,3) defined by predetermined values NER0 to NER3 of the engine rotational speed NE and predetermined values PBAR0 to PBAR3 of the intake pipe absolute pressure PBA. By retrieving these maps, map values suitable for engine operating conditions are determined. In addition, these KVP, KVI, KVD, and NI maps each consist of a plurality of sub-maps stored in the memory means 5c (ROM) to be selected for exclusive use depending on operating conditions of the engine, e.g. on whether the engine is in a normal operating condition, whether the engine has changed its operating mode, whether the engine is decelerating, etc., so that the optimum map values can be determined.

Then, at a step S66, the thinning-out variable NIVR is set to the value or number NI determined at the step S65, and the program proceeds to a step S67 where there is calculated a difference ΔV(n) between the initial desired value VRREF determined at the step S34 of the FIG. 4 routine and the output voltage VO2 from the O2 sensor 17 detected in the present loop.

Then, at a step S68, desired values VREFP(n), VREFI(n), and VREFD(n) for the respective correction terms, i.e. P term, I term, and D term, are calculated by the use of the following equations (3) to (5):

$$VREFP(n)=\Delta V(n)\times KVP \quad (3)$$

$$VREFI(n)=VREF+\Delta V(n)\times KVI \quad (4)$$

$$VREFD(n)=(\Delta V(n)-\Delta V(n-1))\times KVD \quad (5)$$

and then these desired values are added up by the use of the following equation (6):

$$VREF(n)=VREFP(n)+VREFI(n)+VREFD(n) \quad (6)$$

to determine the desired value VREF(n) of the output voltage VO2 from the O2 sensor 17 used in the O2 feedback control.

Figure 9:
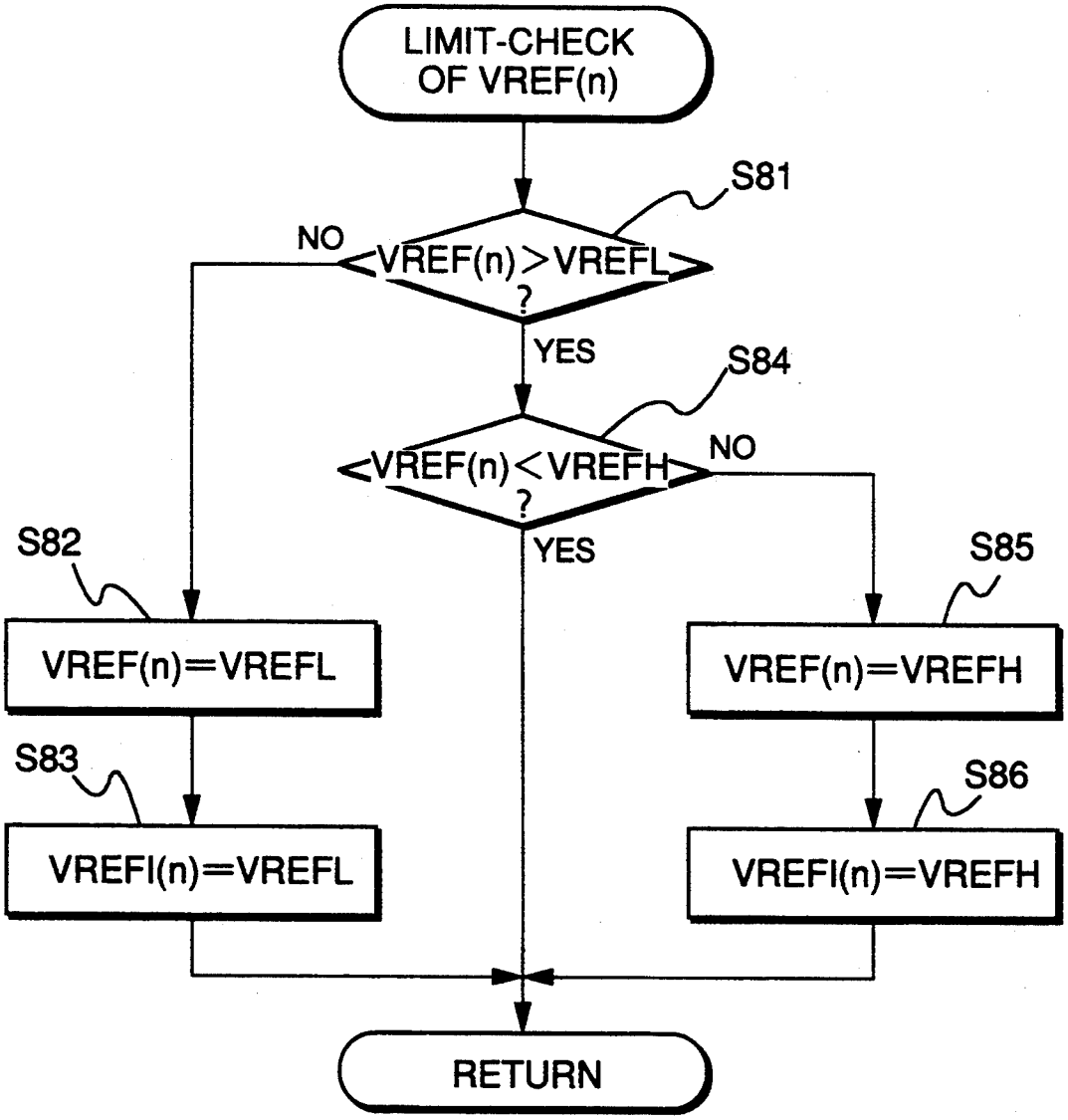
FIG. 9 is a flowchart of a VREF(n) limit-check routine.

Then, at a step S69, a limit check of the desired value VREF(n) determined at the step S68 is carried out. FIG. 9 shows a routine for the limit check, which is executed in synchronism with generation of TDC signal pulses.

First, at a step S81, it is determined whether or not the desired value VREF(n) is larger than a predetermined lower limit value VREFL (e.g. 0.2 V). If the answer to this question is negative (NO), the desired value VREF(n) and the I term desired value VREFI(n) are set to the predetermined lower limit value VREFL at respective steps S82 and S83, followed by terminating this program.

On the other hand, if the answer to the question of the step S81 is affirmative (YES), it is determined at a step S84 whether or not the desired value VREF(n) is lower than a predetermined higher limit value VREFH (e.g. 0.8 V). If the answer to this question is affirmative (YES), it means that the desired value VREF(n) falls in a range defined by the predetermined upper and lower limit values VREFH and VREFL, so that the present routine is terminated without modifying the VREF(n) value determined at the step S68, whereas if the answer to the question of the step S84 is negative (NO), the desired value VREF(n) and the I term desired value VREFI(n) are set to the predetermined upper limit value VREFH at respective steps S85 and S86, followed by terminating this routine.

Thus, the limit check of the desired value VREF(n) is terminated, and then the program returns to a step S70 of the FIG. 7 routine, where the air-fuel ratio correction value ΔKCMD is determined.

Figure 10:
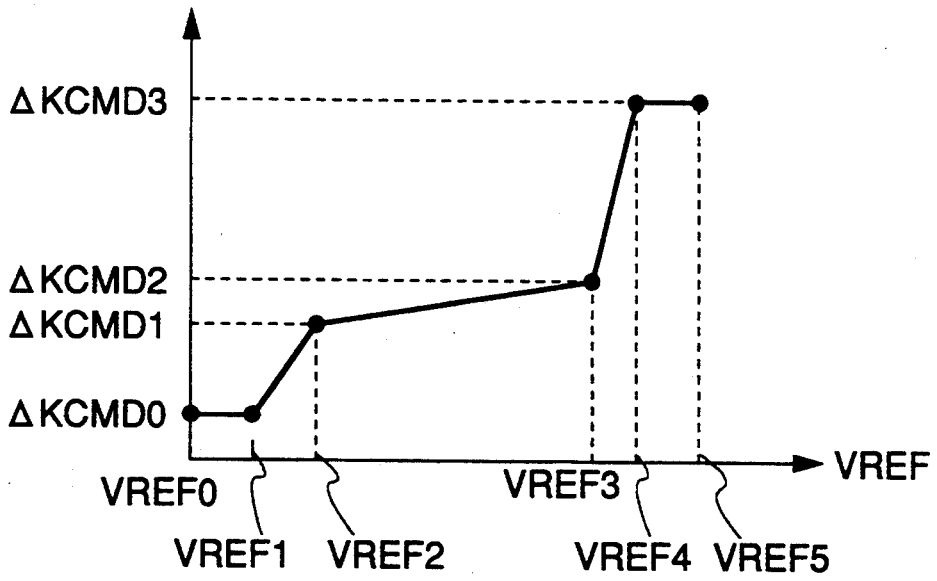
FIG. 10 is a ΔKCMD table

The air-fuel ratio correction value ΔKCMD is determined e.g. by retrieving a ΔKCMD table shown in FIG. 10. The ΔKCMD table is set such that table values ΔKCMD0 to ΔKCMD3 are provided correspondingly to predetermined values VREF0 to VREF5 of the desired value VREF. The air-fuel ratio correction value ΔKCMD is determined by retrieving the ΔKCMD table, or additionally by interpolation, if required. As is clear from FIG. 10, the ΔKCMD value is generally set to a larger value as the desired value VREF(n) assumes a larger value. Further, the VREF value has been subjected to the limit-check at the step S69, and accordingly, the air-fuel ratio correction value ΔKCMD is also set to a value in a range defined by predetermined upper and lower limit values.

Then, at a step S71, the air-fuel ratio correction value ΔKCMD is added to the desired air-fuel ratio correction coefficient KCMD to calculate the modified desired air-fuel ratio coefficient KCMDM (equivalent to the stoichiometric air-fuel ratio in the present case), followed by terminating this routine.

On the other hand, if the answer to the question of the step S64 is negative (NO), i.e. if the output voltage VO2 from the O2 sensor 17 is equal to or higher than the predetermined lower limit value VL but equal to or lower than the predetermined higher limit value VH, i.e. if VL≦VO2≦VH, the O2 feedback control is inhibited, and hence the program proceeds to steps S72 to S74, where the aforementioned difference ΔV (between VRREF and VO2), the desired value VREF, and the air-fuel ratio correction value ΔKCMD are held at the values assumed in the immediately preceding loop, respectively, followed by terminating the program. This prevents the O2 feedback control from being unnecessarily carried out when the air-fuel ratio of the mixture is determined to remain substantially equal to the stoichiometric value, to thereby attain excellent controllability, that is, to stabilize the air-fuel ratio of the mixture.

Figure 11:
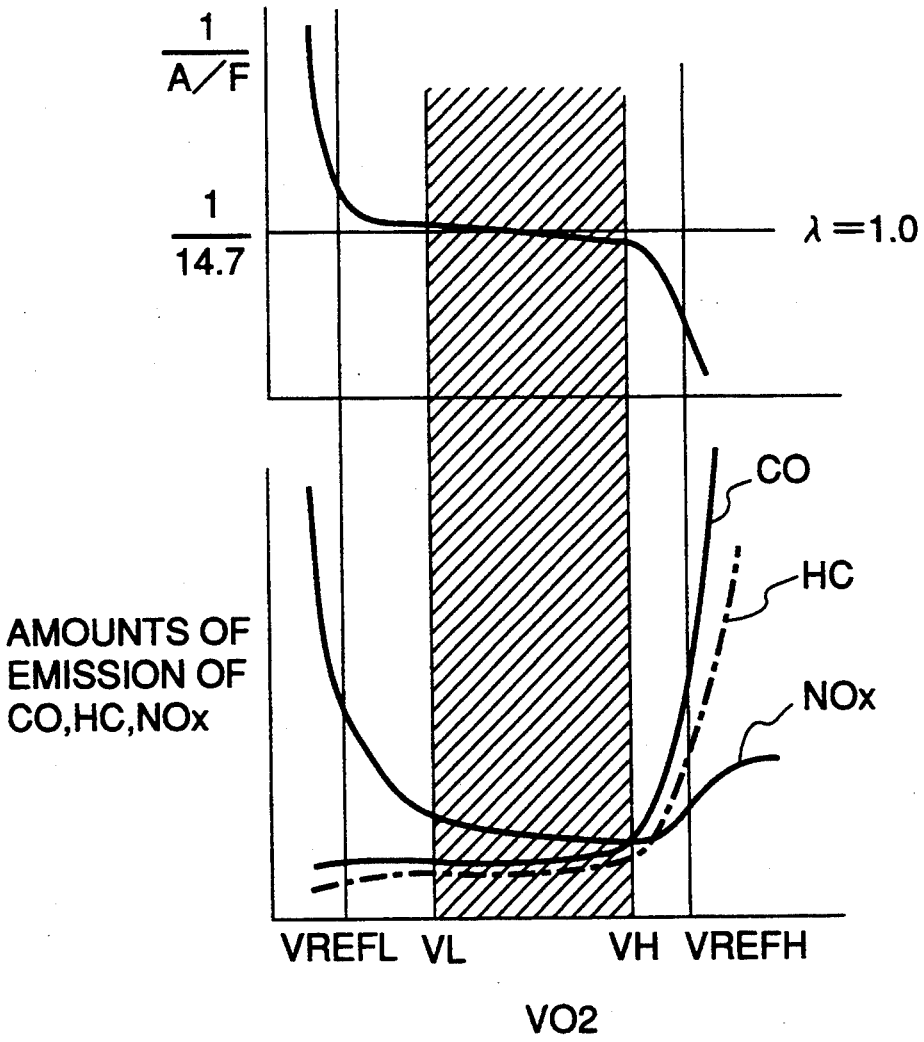
FIG. 11 is a characteristic diagram showing the relationships between output voltage VO2 form the O2 sensor and an equivalent ratio (1/(A/F)) of the air-fuel ratio (A/F) depicted in relation to amounts of emission of noxious components of exhaust gases.

FIG. 11 shows the relationships between the output voltage VO2 from the O2 sensor 17, the desired air-fuel ratio coefficient KCMD, and amounts of emission of noxious components.

As shown in FIG. 11, in the present embodiment, when the output voltage VO2 from the O2 sensor 17 falls within the predetermined range, i.e. if VL≦VO2≦VH (corresponding to a hatched part in FIG. 11), the air-fuel ratio of the mixture remains substantially equal to 14.7 without executing the O2 feedback control, so that the O2 feedback control is inhibited, whereas only if the output voltage VO2 falls outside the predetermined range and at the same time within the predetermined upper and lower limit values VREFL and VREFH, i.e. if VREFL<VO2<VL or if VH<VO2<VREFH, the O2 feedback control is carried out to correct the desired air-fuel ratio coefficient KCMD, whereby the air-fuel ratio of the mixture can be accurately feedback-controlled to the stoichiometric air-fuel ratio to improve the exhaust emission characteristics. Further, the output voltage VO2 from the O2 sensor 17 has a wide value range, as indicated by hatching, in which the amount of emission of noxious components, such as CO, HC and NOx, is small. Therefore, by inhibiting the O2 feedback control in this wide value range of the output value VO2, excellent controllability of the air-fuel ratio is attained, which prevents fluctuation of the air-fuel ratio across the stoichiometric value. Further, if VO2<VREFL or if VO2>VREFH as well, the O2 feedback control is inhibited and the desired value of the output voltage VO2 from the O2 sensor 17, and hence the desired air-fuel ratio coefficient KCMD is held to the upper or lower limit value, which contributes to reducing the emission of noxious components, such as NOx, HC, and CO, whereby the exhaust emission characteristics during control of the air-fuel ratio of the mixture to the stoichiometric value can be improved.

Figure 13:
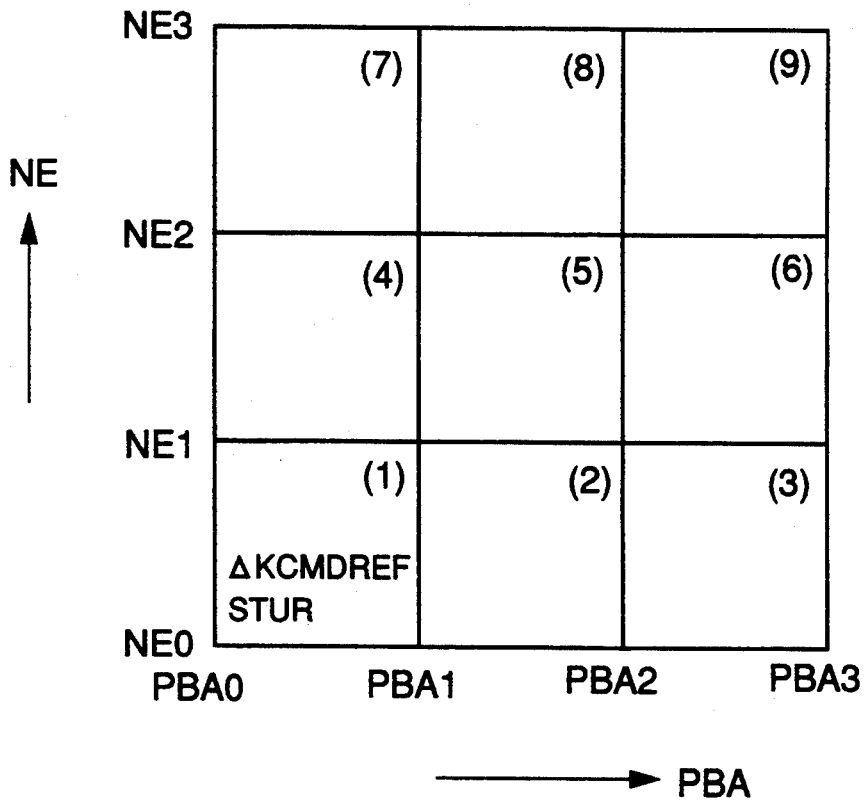
FIG. 13 shows a STUR map.
Figures 12, 12A, 12B:
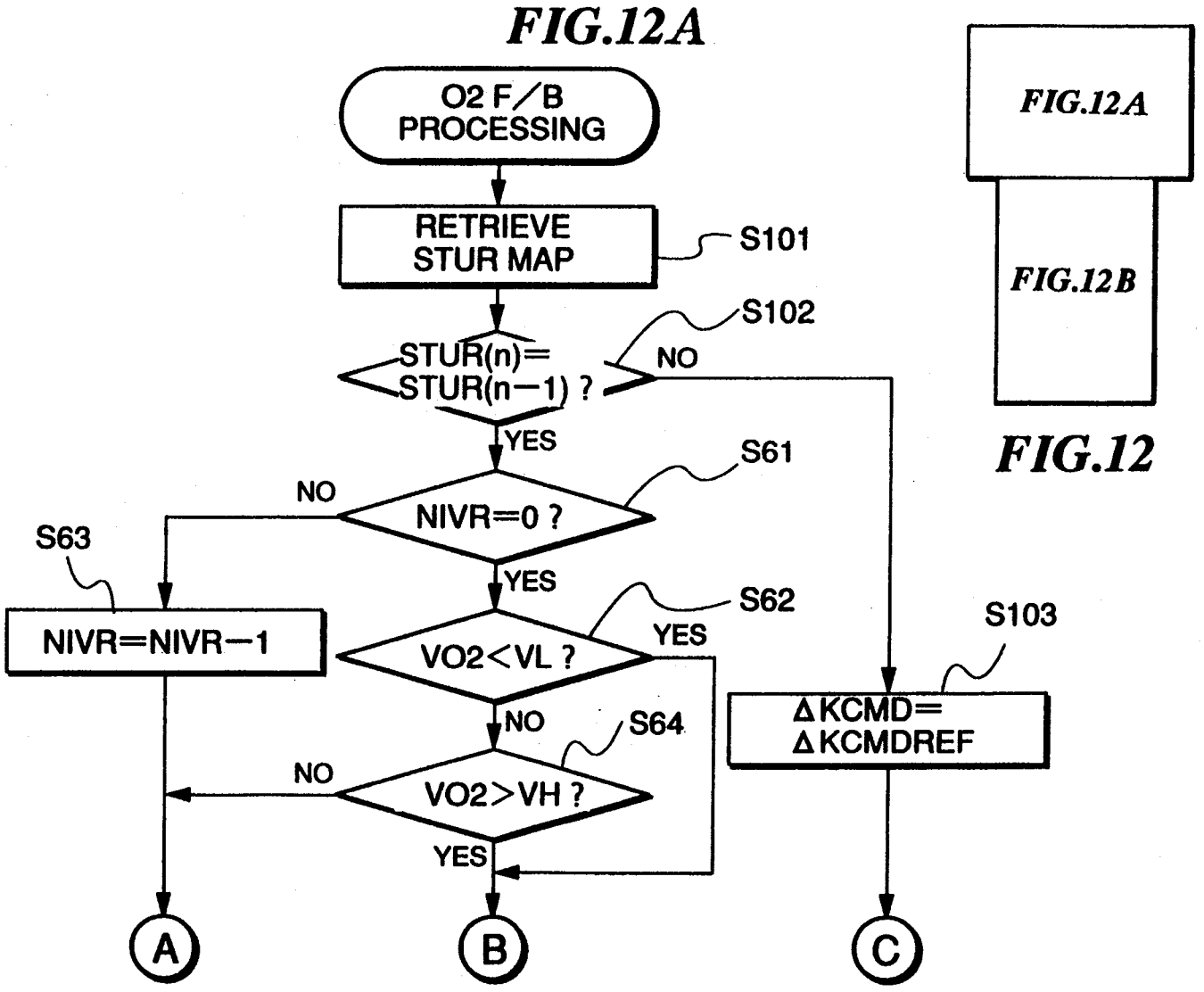
FIG. 12 comprised of FIG. 12A
FIG. 12B is a flowchart of an O2 feedback control routine according to a second embodiment of the invention.
Figure 12B:
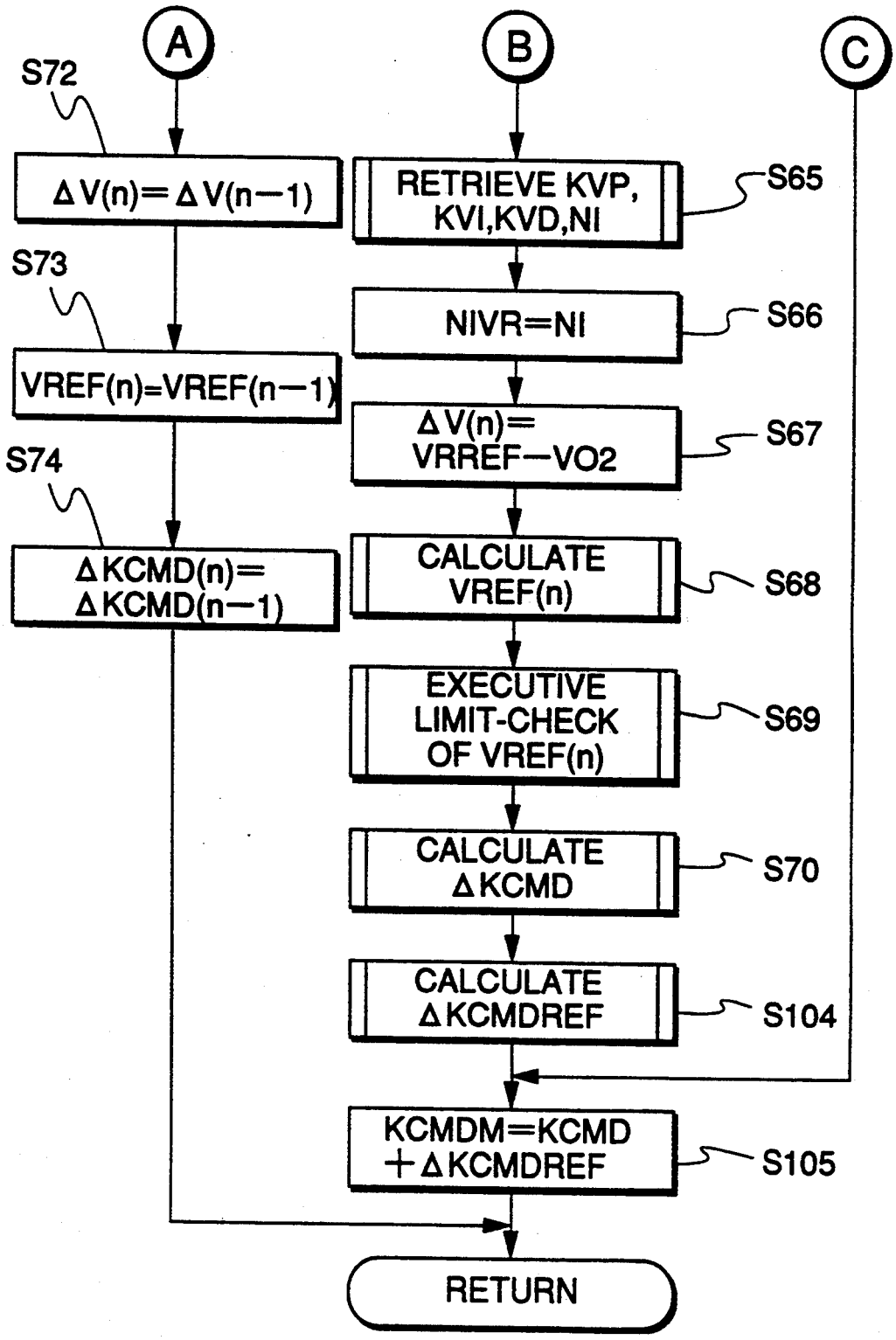

Referring next to FIGS. 12 and FIG. 13, a second embodiment of the invention will be described. This embodiment is distinguished from the first embodiment in that the O2 feedback processing to be executed at the step S44 of the FIG. 4 routine is carried out according to a subroutine shown in FIG. 12. The FIG. 12 subroutine is distinguished from the FIG. 7 subroutine of the first embodiment in that new steps S101 to S104 are additionally provided and a new step S105 replaces the step S71, the other steps remaining the same as those in FIG. 7 and designated by the same reference numerals.

More specifically, First, at the new step S101, a STUR map is retrieved to determine an engine operating region STUR in which the engine is operating and an average value ΔKCMDREF of the air-fuel ratio correction value ΔKCMD (hereinafter this average value is referred to as "the learned value").

The STUR map is set, e.g. as shown in FIG. 13, such that operating regions STUR(1) to STUR(9) are provided correspondingly to predetermined values PBA0 to PBA4 of the intake pipe absolute pressure PBA and predetermined values NE0 to NE4 of the engine rotational speed NE, with values ΔKCMDREF(1) to Δ KCMDREF(9) of the learned value obtained in these respective regions. By retrieving this STUR map, the engine operating region STUR(i) and the learned value A KCMDREF(i) (i=1 to 9) are determined. In this connection, the learned value ΔKCMDREF (i) is calculated by an equation (7), referred to hereinafter, when the engine is operating in each of the above regions, and stored into the memory means 5c, as will be described later.

Next, at the new step S102, it is determined whether or not the operating region STUR(n) in the present loop is the same as the operating region STUR(n−1) in the immediately preceding loop.

If the answer to this question is negative (NO), i.e. if the operating region STUR in the present loop has changed from that in the immediately preceding loop, the air-fuel ratio correction value ΔKCMD is set to a learned value ΔKCMDREF corresponding to the operating region STUR(n) in the present loop at the new step S103, and then the program proceeds to a step S105.

On the other hand, if the answer to the question of the step S102 is affirmative (YES), the program proceeds to the step S61. Then, the same processing as in the FIG. 7 subroutine is carried out until the program reaches the step S70, and then the program proceeds to the new step S104.

At the step S104, the learned value ΔKCMDREF(n) is calculated by the use of the following equation (7):

$$\Delta KCMDREF(n)=(CREF/65536)\times\Delta KCMD+[(65536-CREF)/65536]\times\Delta KCMDREF(n-1) \quad (7)$$

where CREF represents a variable which is set, depending on operating conditions of the engine, to a proper value in the range of 1 to 65536, and ΔKCMDREF(n−1) the immediately preceding value of the learned value ΔKCMDREF. Thus, the air-fuel ratio correction value ΔKCMD is learned based on the immediately preceding value ΔKCMDREF(n−1) thereof to update the learned value ΔKCMDREF in each operating region STUR, which makes it possible to perform the air-fuel ratio feedback control, always by the use of a proper value of the desired air-fuel ratio coefficient free from the influence of aging of the O2 sensor 17, i.e. accurately to the stoichiometric air-fuel ratio.

Then, all a step S105, the learned value ΔKCMDREF is added to the desired air-fuel ratio coefficient KCMD determined at the step S22 of the FIG. 3 routine to calculate the modified desired air-fuel ratio coefficient KCMDM (equivalent to the stoichiometric air-fuel ratio), followed by terminating this routine.

Thus, according to the present embodiment, if the engine operating region in the present loop is the same as that in the immediately preceding loop, the average value of the air-fuel ratio correction value Δ KCMD is updated, and the desired air-fuel ratio coefficient KCMD is corrected by the use of the resulting average value, whereas if the former is different from the latter, the desired air-fuel ratio coefficient KCMD is corrected by the average value of the air-fuel ratio correction value stored in the memory means, which reduces computation load and improves follow-up capability of the air-fuel ratio control in response to changes in operating conditions of the engine, as well as makes it possible to perform a very accurate air-fuel ratio feedback control in a desired manner without being adversely affected by aging of the O2 sensor.

What is claimed is:

1. In an air-fuel ratio control system for an internal combustion engine having an exhaust passage and a catalytic converter arranged in said exhaust passage for purifying noxious components contained in exhaust gases, said air-fuel ratio control system including a first exhaust gas ingredient concentration sensor arranged in said exhaust passage at a location upstream of said catalytic converter and having an output characteristic which is substantially proportional to the concentration of an ingredient in said exhaust gases, engine operating condition-detecting means for detecting operating conditions of said engine, desired air-fuel ratio coefficient-calculating means for calculating a desired air-fuel ratio coefficient used in calculating an amount of fuel supplied to said engine, based on results of detection by said engine operating condition-determining means, a second exhaust gas ingredient concentration sensor arranged in said exhaust passage at a location downstream of said catalytic converter and having an output characteristic that an output therefrom drastically changes in the vicinity of a stoichiometric air-fuel ratio of a mixture supplied to said engine, and correcting means for correcting said desired air-fuel ratio coefficient based on said output from said second exhaust gas ingredient concentration sensor, wherein the air-fuel ratio of said mixture detected by said first exhaust gas ingredient concentration sensor is feedback-controlled to said stoichiometric air-fuel ratio based on said desired air-fuel, ratio coefficient corrected by said correcting means, the improvement comprising:

inhibiting means for inhibiting said correcting means from making a correction to said desired air-fuel ratio coefficient when said output from said second exhaust gas ingredient concentration sensor falls within a predetermined range, and means for holding said desired air-fuel ratio coefficient to a value assumed immediately before said correcting means has been inhibited from making said correction, when said inhibiting means has inhibited said correcting means from making said correction.

2. An air-fuel ratio control system according to claim 1, wherein said predetermined range of said output from said second exhaust gas ingredient concentration sensor is a range within which the air-fuel ratio of said mixture is substantially equal to said stoichiometric value.

3. An air-fuel ratio control system according to claim 1 or 2, wherein said correcting means comprises an atmospheric pressure sensor for detecting atmospheric pressure, an initial value-determining means for determining an initial value of a desired value of said output from said second exhaust gas ingredient concentration sensor based on results of detection by said atmospheric pressure sensor, desired value-calculating means for calculating said desired value of said output from said second exhaust gas ingredient concentration sensor based on a difference between said initial value of said desired value and said output from said second exhaust gas ingredient concentration sensor, and desired value-setting means for setting said desired value of said output from said second exhaust gas ingredient concentration sensor to a predetermined upper or lower limit value when said desired value calculated by said desired value-calculating means falls outside a range defined by said predetermined upper and lower limit values.

4. An air-fuel ratio control system according to claim 3 wherein said correcting means corrects said desired air-fuel ratio coefficient based on said desired value of said output from said second exhaust gas ingredient concentration sensor.

5. An air-fuel ratio control system according to claim 3, said correcting means comprising an average value-calculating means for calculating an average value of said desired value calculated by said desired value-calculating means, operating region-determining means for determining, based on results of detection by said engine operating condition-detecting means, in which operating region of a plurality of operating regions said engine is operating, and memory means for storing a value of said average value calculated by said average value-calculating means in each of said operating regions, wherein if an operating region determined by said operating region-determining means in the present loop is equal to that determined in the immediately preceding loop, said average value of said desired value is updated, and said desired air-fuel ratio coefficient is corrected based on said updated average value, whereas if an operating region determined by said operating region-determining means in the present loop is different from that determined in the immediately preceding loop, said desired air-fuel ratio coefficient is corrected based on said average value of said desired value stored in said memory means.

* * * * *